US010390610B2

(12) United States Patent
Nelson

(10) Patent No.: US 10,390,610 B2
(45) **Date of Patent: *Aug. 27, 2019**

(54) LEISURE SEATING WORKSTATION

(71) Applicant: THE LOVESAC COMPANY, Stamford, CT (US)

(72) Inventor: Shawn Nelson, Washington, UT (US)

(73) Assignee: THE LOVESAC COMPANY, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/906,798

(22) Filed: Feb. 27, 2018

(65) Prior Publication Data

US 2018/0184798 A1 Jul. 5, 2018

Related U.S. Application Data

(63) Continuation of application No. 14/936,972, filed on Nov. 10, 2015, now Pat. No. 9,936,800.
(Continued)

(51) Int. Cl.
*A47B 13/08* (2006.01)
*A47B 83/00* (2006.01)
(Continued)

(52) U.S. Cl.
CPC ..... *A47B 13/081* (2013.01); *A47B 39/023* (2017.08); *A47B 83/001* (2013.01); *A47B 83/02* (2013.01)

(58) Field of Classification Search
CPC ..... A47B 13/081; A47B 39/023; A47B 39/02; A47B 83/001; A47B 1/10; A47B 83/02; A47B 83/0215; A47B 83/021; A47C 7/54
(Continued)

(56) References Cited

U.S. PATENT DOCUMENTS 2,383,831 A * 8/1945 Walker ..... A47B 83/02 297/125
2,956,617 A * 10/1960 Bruderer ..... A47B 83/02 297/138

(Continued)

FOREIGN PATENT DOCUMENTS

CN 104523027 A 4/2015

OTHER PUBLICATIONS

Envelop Desk from Herman Miller, from materialicious.com, published, on information and belief, in 2010, printed Aug. 10, 2015, 5 pages.

(Continued)

*Primary Examiner* — Milton Nelson, Jr.
(74) *Attorney, Agent, or Firm* — Workman Nydegger

(57) ABSTRACT

A workstation assembly configured to ergonomically, comfortably seat and provide workspace for a user, comprising a chair having a base portion on which a user sits, and at least one armrest; and a desk comprising a desk frame, a sliding assembly mounted on a desk frame, and a desktop mounted on a sliding assembly, wherein the desk is configured such that the desktop can be in a compact position with respect to the desk frame, or can be moved from the compact position to an extended position with respect to the desk frame, wherein, in the extended position, a distal portion of the desktop is positioned on the at least one arm rest.

18 Claims, 15 Drawing Sheets

Related U.S. Application Data

(60) Provisional application No. 62/197,703, filed on Jul. 28, 2015.

(51) Int. Cl.
*A47B 83/02* (2006.01)
*A47B 39/02* (2006.01)

(58) Field of Classification Search
USPC ..... 297/143, 149, 151, 148, 174 R
See application file for complete search history.

(56) References Cited

U.S. PATENT DOCUMENTS

| | | | |
|---|---|---|---|
| 5,172,641 | A | 12/1992 | Auer |
| 5,437,235 | A | 8/1995 | Randolph |
| 5,810,431 | A | 9/1998 | Gibson |
| 6,102,476 | A | 8/2000 | May et al. |
| 6,454,358 | B1 | 9/2002 | Benincasa |
| 6,474,760 | B2 | 11/2002 | Rauls |
| 6,874,431 | B1 | 4/2005 | Danna |
| 7,862,111 | B2 | 1/2011 | Steenson |
| 9,072,377 | B2 | 7/2015 | Beimborn |
| 9,936,800 | B2 | 4/2018 | Nelson et al. |
| 2005/0268825 | A1 | 12/2005 | Mueller et al. |
| 2010/0024691 | A1 | 2/2010 | Weber |
| 2011/0017105 | A1 | 1/2011 | Valdivia |
| 2013/0264298 | A1 | 10/2013 | Shih et al. |
| 2014/0084642 | A1 | 3/2014 | Park |
| 2017/0027318 | A1 | 2/2017 | Nelson et al. |

OTHER PUBLICATIONS

Enthralling Computer Desk for Gaming Modern Design, from groovexi.com, published, on information and belief, in 2013, printed Aug. 11, 2015, 10 pages.

Sumptuous Ergonomic Gaming Workstation With Game Chair, Computer and Speakers, from groovexi.com, published, on information and belief, in 2013, printed Aug. 10, 2015, 5 pages.

Traditional Table with a Modern Twist, StudioDesk, from bluelounge.com, printed Aug. 10, 2015, 9 pages.

Screen print, Envelop Desk from Herman Miller, published, on information and belief, in 2010, printed Aug. 11, 2015, 1 page.

U.S. Appl. No. 14/936,972, Aug. 11, 2017, Office Action.

U.S. Appl. No. 14/936,972, Nov. 30, 2017, Notice of Allowance.

Issue notification dated Mar. 21, 2018, issued in U.S. Appl. No. 14/936,972.

* cited by examiner

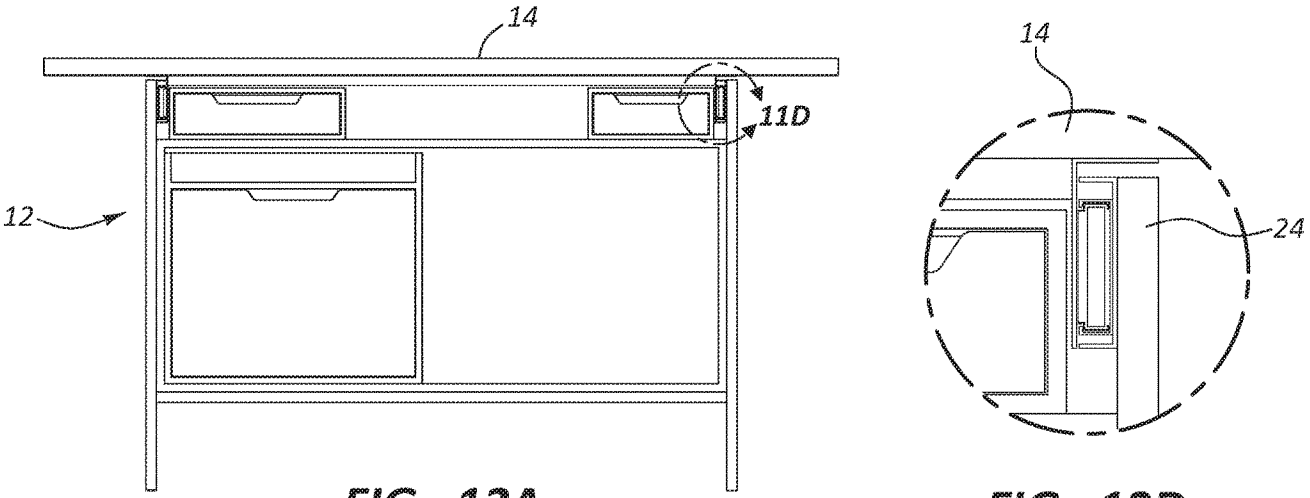
FIG. 12A
FIG. 12D
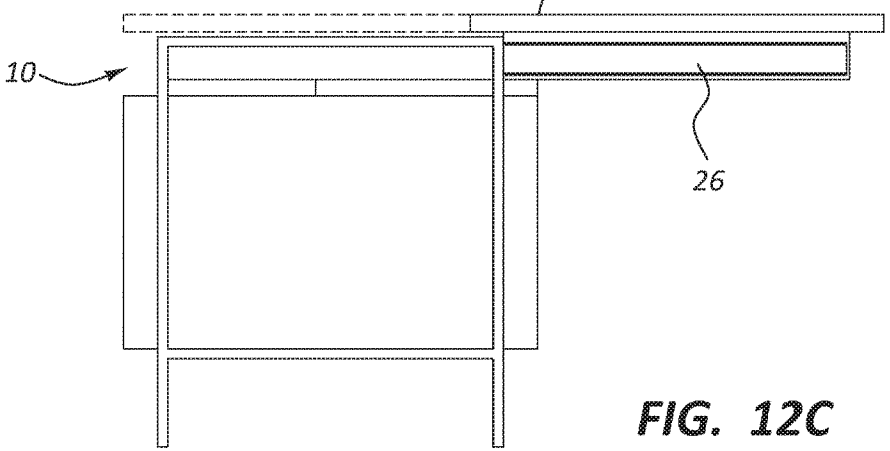
FIG. 12C
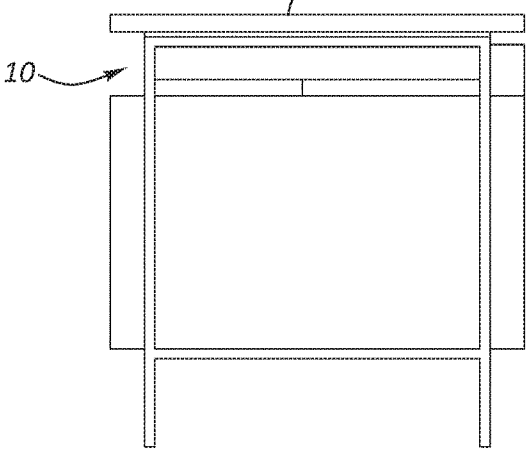
FIG. 12B

LEISURE SEATING WORKSTATION

PRIORITY APPLICATION

This non-provisional patent application is a continuation of U.S. non-provisional patent application Ser. No. 14/936,972, filed on Nov. 10, 2015 entitled LEISURE SEATING WORKSTATION, which claims priority to and the benefit of U.S. provisional patent application Ser. No. 62/197,703, dated Jul. 28, 2015 and entitled WORKSTATION DESK AND ASSEMBLIES, each of which is incorporated herein in its entirety by reference.

BACKGROUND OF THE INVENTION

1. The Field of the Invention

This invention is in the field of workstations, desks and chairs.

2. The Relevant Technology

Workplace physical fatigue and discomfort can occur in office settings in which workers spend hours at desks pouring over documents and typing on computers. It is desirable to find workplace desk solutions that enable a user to comfortably and ergonomically sit at a desk for long periods of time, increasing worker satisfaction and efficiency.

SUMMARY OF THE INVENTION

A symbiotic workstation assembly of the present invention is configured to ergonomically, comfortably seat and provide workspace for a user. As shown in FIGS. 1 and 2, the symbiotic workstation assembly comprises: (i) a chair having a seat on which a user sits, and at least one armrest; and (ii) a desk comprising (A) a desk frame, (B) a sliding assembly mounted on a desk frame, and (C) a desktop mounted on a sliding assembly, wherein the desk is configured such that the desktop can be in a compact position with respect to the desk frame, or can be moved from the compact position to an extended position with respect to the desk frame, wherein, in the extended position, a distal portion of the desktop is positioned on the at least one arm rest.

The desk and chair are symbiotically oriented with respect to each other such that a user on the chair can comfortably sit thereon with the user's back against the backrest, the pull the distal end of the sliding desktop toward the user's lap and/or abdomen, such that the desktop is adjacent (e.g., on or near) the user's lap and/or abdomen. In this position, the user can conveniently work on a keyboard or paperwork (see FIG. 3) similar to sitting on a couch with a computer comfortably in the user's lap, or can lean onto the desktop with the user's elbows thereon (see FIG. 4) if the user wants to change sitting positions, which can be therapeutic during a long work day.

One primary advantage, as shown in FIG. 3, of the symbiotic workstation assembly of the present invention is that the user can conveniently use the desktop adjacent the user's lap and/or abdomen without being required to lean toward the desktop as is required in a typical work furniture chair/desk setting. As shown in FIG. 3, this allows a user to lean against the backrest, supporting the user's back in a more healthy manner, while still having a work area adjacent the user's lap/abdomen for erganonically comfortable and conveniently working. The user is not required to strain the user's back by moving away from the backrest in order to reach the desktop. If, however, the user wants to move the user's back during the day, the user can lean forward and place the user's elbows on the desktop, as shown in FIG. 4, which can relax the back by changing its position from sitting straight all day.

The sitting dynamic of FIGS. 3 and 4 in the workplace is somewhat similar to the dynamic of sitting on a couch with a laptop computer or paper work in a user's lap, comfortably working with the user's back leaning against a backrest of the couch, which is preferred by many users for ergonomic and relaxation reasons. However, as shown in FIG. 3, the desktop provides the added benefit of providing a flat worksurface on which papers and/or a keyboard can be comfortably placed and manipulated.

The symbiotic workstation of the present invention thus provides the benefits of working on a couch, e.g., relaxing the back against a backrest, while providing a rigid desktop on which to perform office work.

In one embodiment, in order to simulate the benefit of working on a couch with a rigid desktop for a workspace, the top surface of the desktop is in the range of approximately 22 inches high to approximately 28 inches high and the top surface of the seat of the chair is in the range of approximately 15 inches high to approximately 21 inches high. For example, in one embodiment, the top surface of the desktop is approximately 25 inches high and the top surface of the seat of the chair is approximately 18 inches high. In one such embodiment, the rigid desktop is about one inch thick, providing approximately 6 inches of legroom, keeping in mind however, that the cushion portion of the seat of the chair may tend to flex downward, providing more than about 6 inches of legroom.

The approximately 22 inches high to approximately 28 inches high sliding desktop of the present invention thus works symbiotically with a chair having a seat height of approximately 15 inches high to approximately 21 inches high.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which:

FIGS. 12A-D show various views of desk 12.

DETAILED DESCRIPTION OF THE PREFERRED EMBODIMENTS

Figure 1:
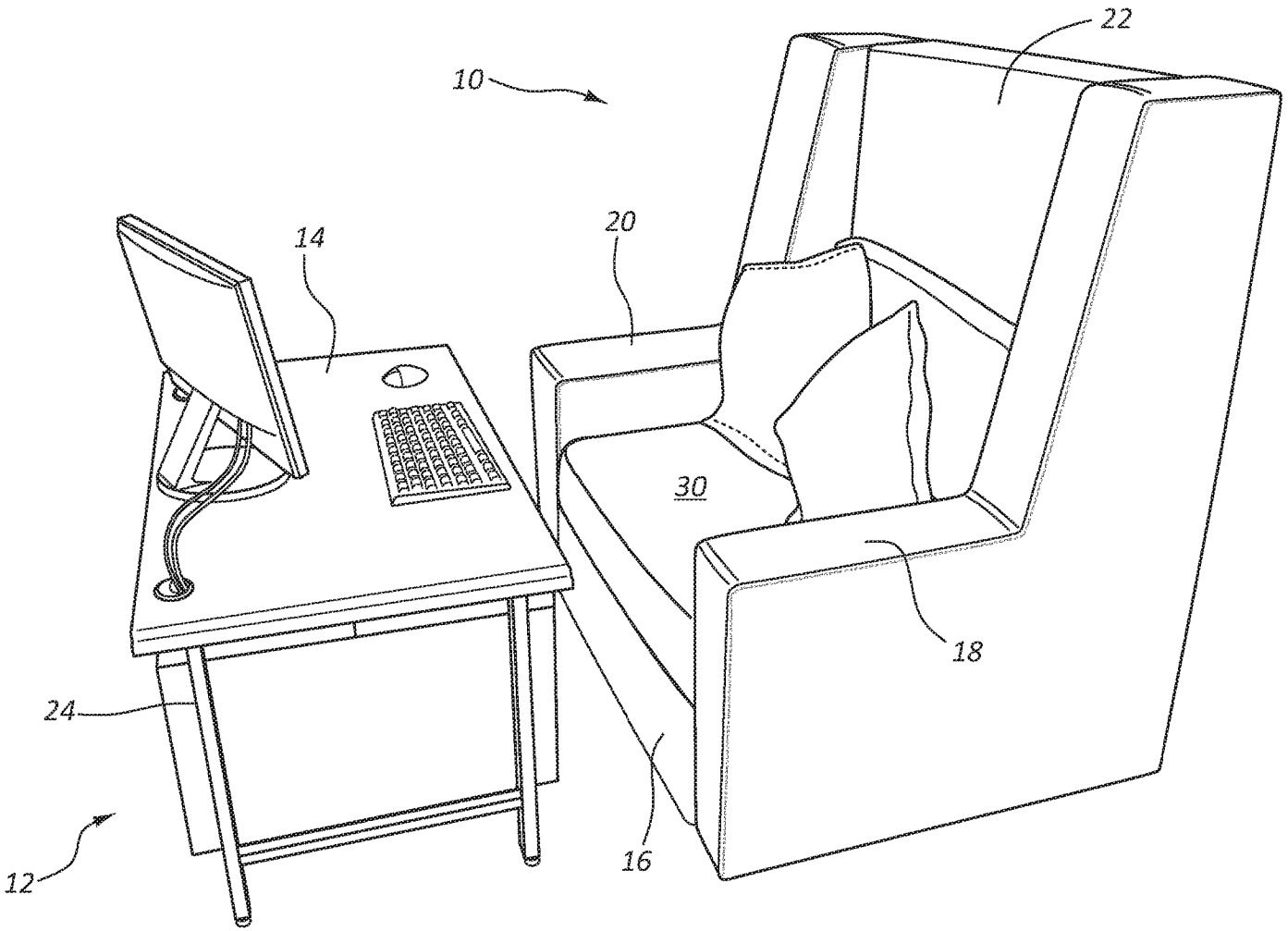
FIGS. 1-4 illustrate a symbiotic workstation assembly of the present invention, comprising a chair 10 and a desk 12, in compact (FIG. 1), partially extended (FIG. 2), fully extended (FIG. 3) and fully extended views with a user leaning thereon (FIG. 4).
Figure 2:
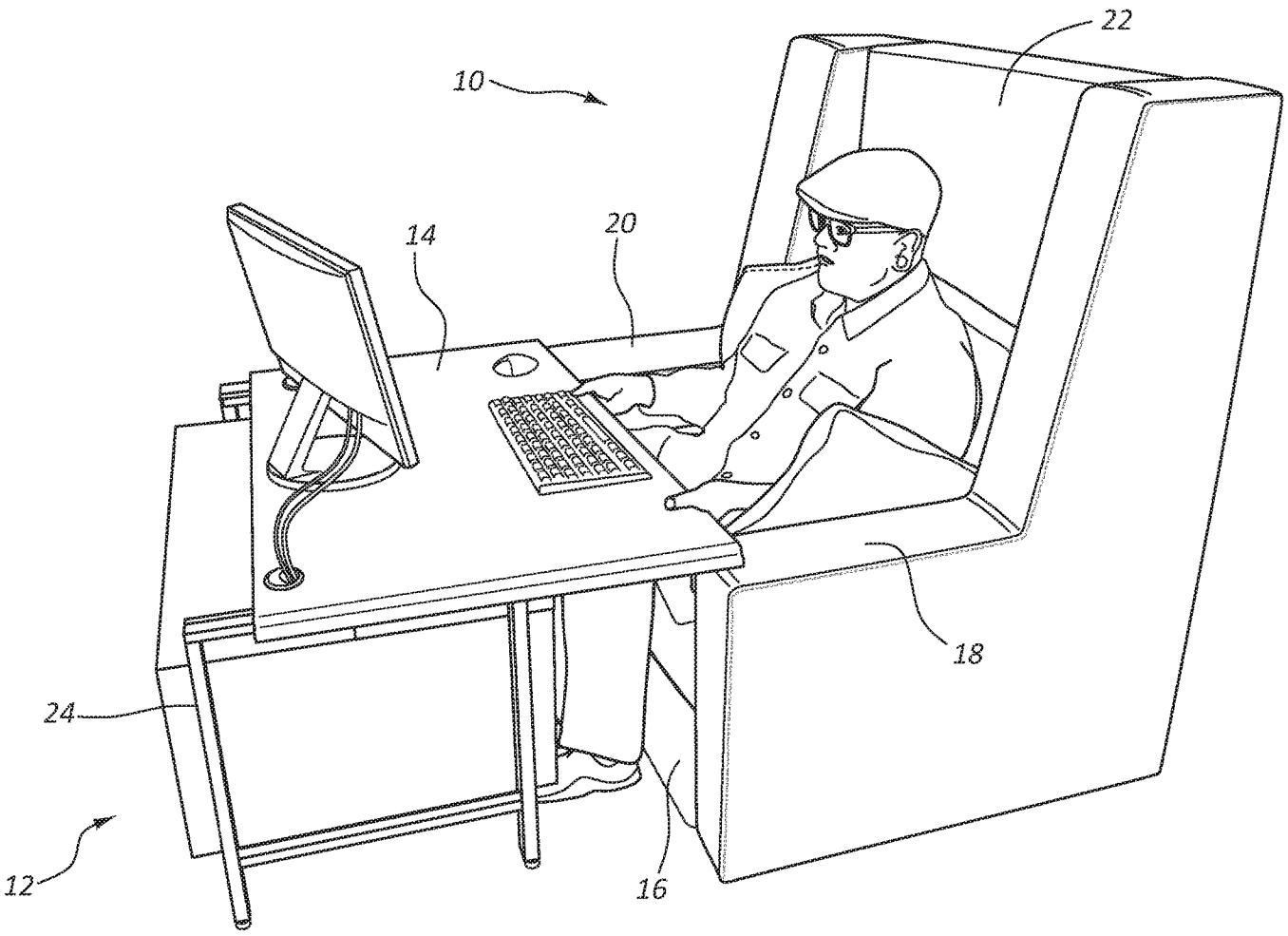

As shown in FIGS. 1 and 2 and 12, the symbiotic workstation assembly comprises: (i) a chair 10 having a seat on which a user sits (comprising base 16 and cushion 30), and at least one armrest 18, 20 linked to base 16; and (ii) a desk 12 comprising (A) a desk frame 24, (B) a sliding assembly 26 mounted on the desk frame 24, and (C) a desktop 14 positioned on the sliding assembly 26, wherein the desk 12 is configured such that the desktop 14 can be in a compact position with respect to the desk frame 24, or can be moved from the compact position to an extended position with respect to the desk frame 24, wherein, in the extended position, a distal portion of the desktop 14 is positioned on the at least one arm rest 18 and/or 20.

The desk 12 and chair 10 are symbiotically oriented with respect to each other such that a user on the chair 10 can comfortably sit thereon with the user's back against the backrest 22, then pull the distal end of the sliding desktop 14 toward the user's lap and/or abdomen, such that the desktop 14 is adjacent (e.g., contacting or near) the user's abdomen. In this position, the user can conveniently work on a keyboard or paperwork (see FIG. 3) or can lean onto the desktop with the user's elbows thereon (FIG. 4) if the user wants to change sitting positions, which is therapeutic during a long work day.

Figure 3:
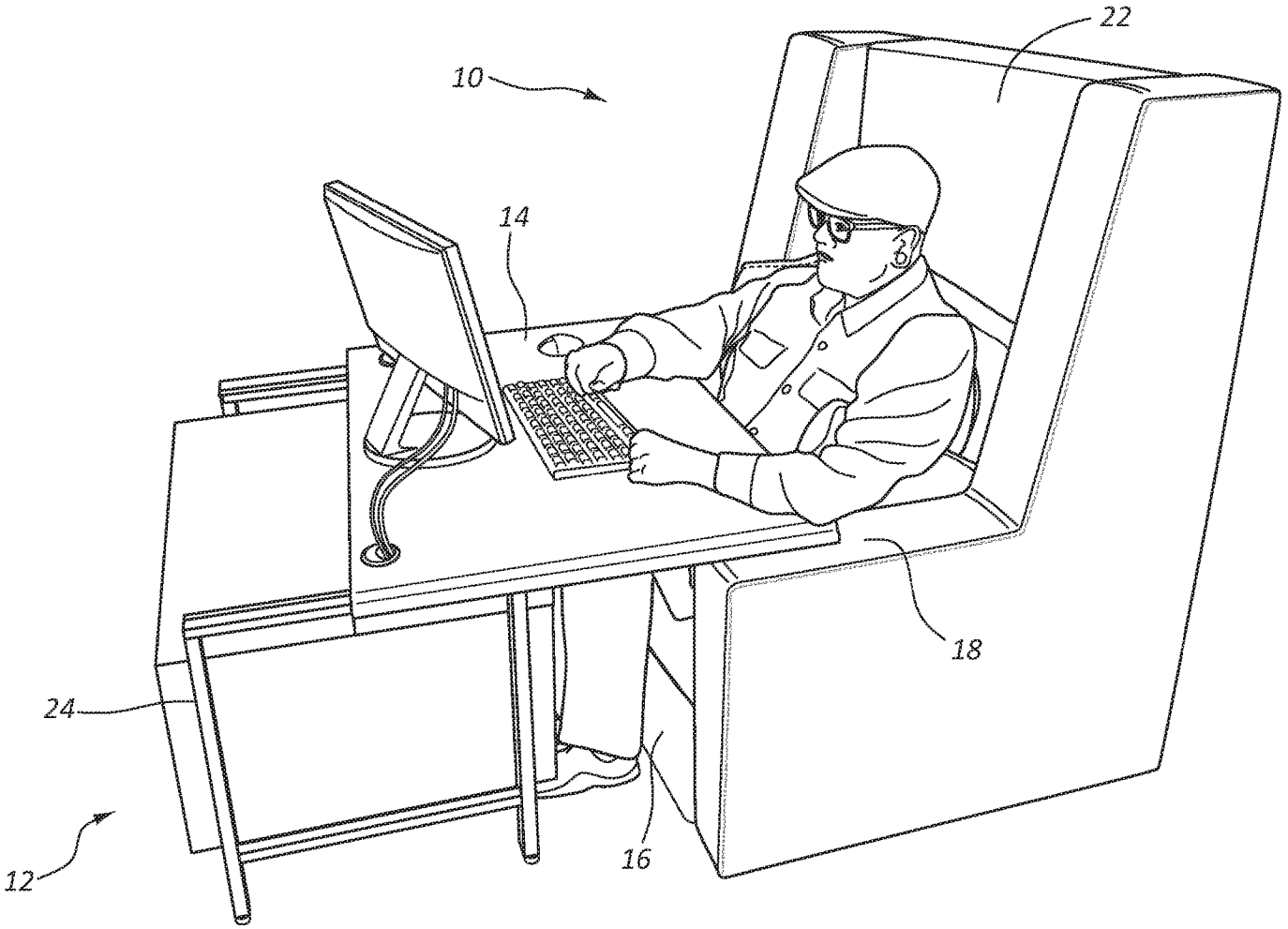
Figure 4:
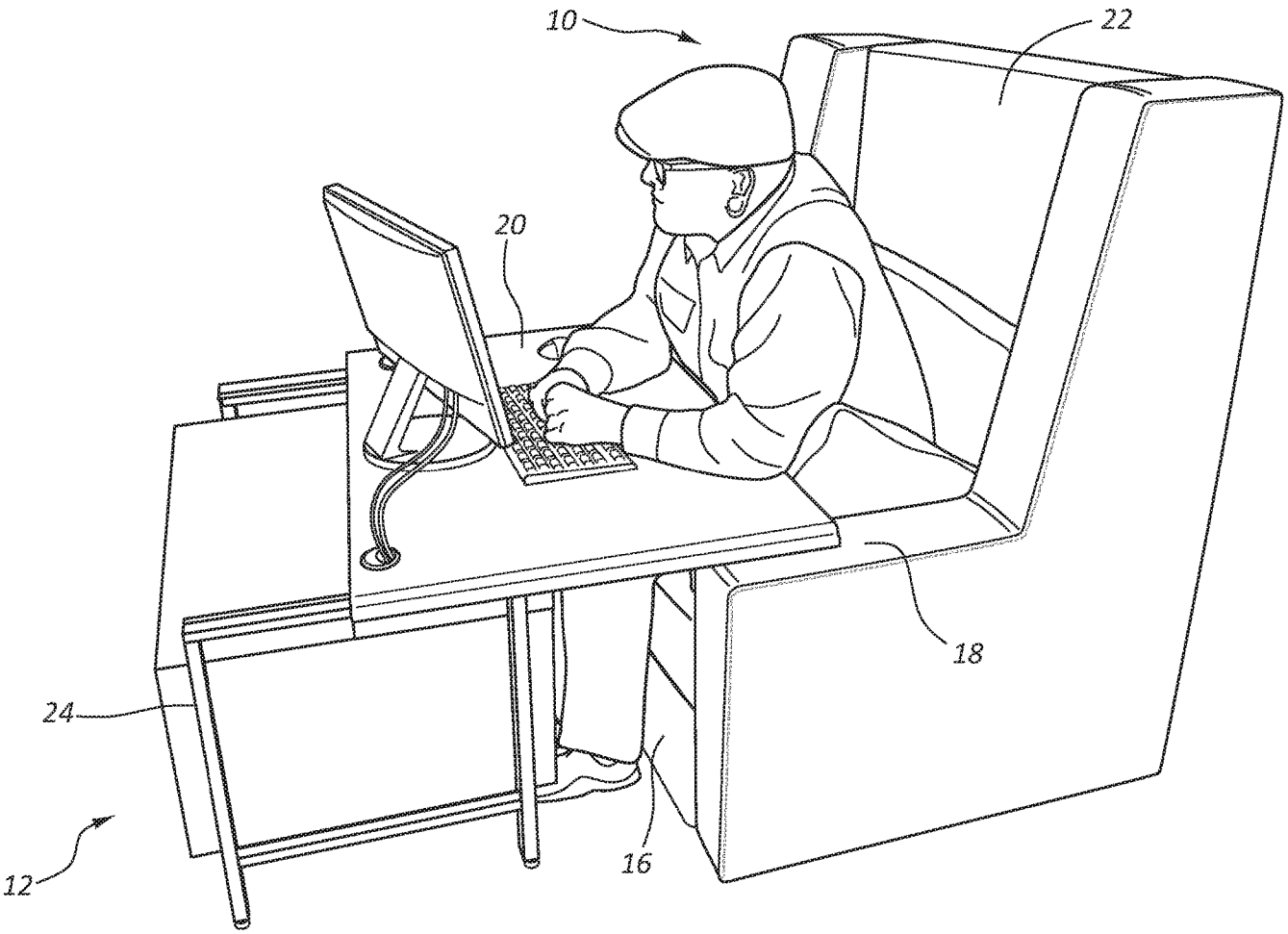

One primary advantage, as shown in FIGS. 3, of the symbiotic workstation assembly of the present invention of the present invention is that the user can conveniently use the desktop 14 adjacent the user's abdomen and/or lap without being required to lean toward the desktop 14 as is required in a typical work furniture chair/desk setting. As shown in FIG. 3, this allows a user to lean against the backrest, supporting the user's back in a healthy manner, while still having a work area adjacent the user's abdomen for erganonically comfortable and conveniently working. The user is not required to strain the user's back by moving away from the backrest in order to reach the desktop 14. If, however, the user wants to move the user's back during the day, the user can lean forward and place the user's elbows on the desktop 14, as shown in FIG. 4, which can relax the back by changing its position from sitting straight all day.

This sitting dynamic in the workplace is similar to the dynamic of sitting on a couch with a laptop computer or paper work in a user's lap, comfortably working with the user's back leaning against a backrest of the couch, which is preferred by many users for ergonomic and relaxation reasons. However, as shown in FIG. 3, the desktop 14 provides the added benefit of providing a flat, broad and wide worksurface on which papers and/or a keyboard can be comfortably placed and manipulated.

The symbiotic workstation of the present invention thus provides the benefits of working on a couch, e.g., relaxing the back against a backrest, while providing a rigid desktop 14 on which to perform office work.

In one embodiment, in order to simulate the benefit of working on a couch with a rigid desktop 14 for a workspace, the top surface of the desktop 14 is in the range of approximately 22 inches high to approximately 28 inches high and the top surface of the seat of the chair is in the range of approximately 15 inches high to approximately 21 inches high. For example, in one embodiment, the top surface of the desktop 14 is approximately 25 inches high and the top surface of the seat of the chair is approximately 18 inches high. The sliding desk of the present invention thus works symbiotically with a chair having a seat height of approximately 15 inches to approximately 21 inches high, for example.

Figure 5:
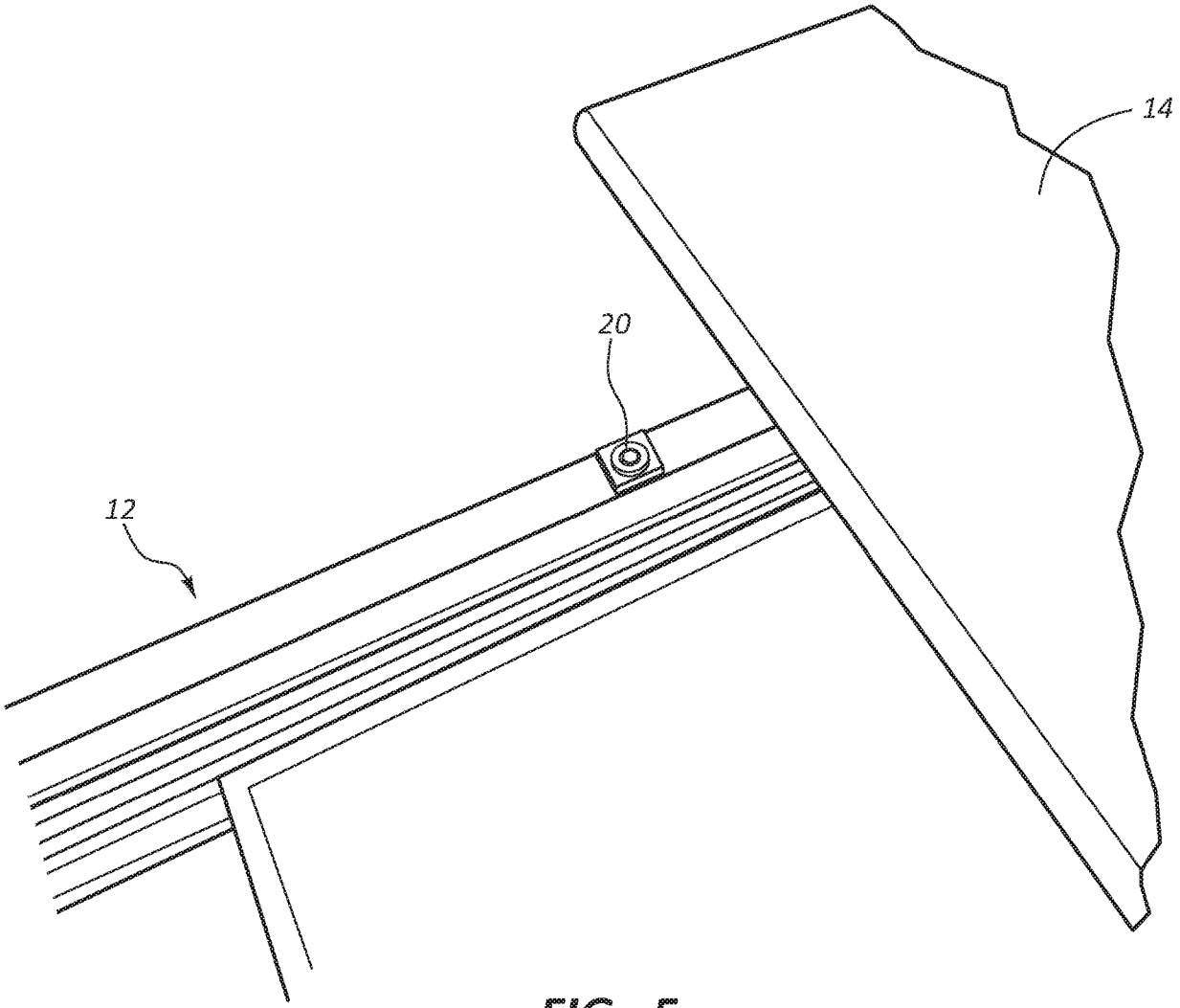
FIG. 5 represents an embodiment of a desk of the present invention in which one or more spring loaded detents provides a temporary stopping location for the sliding of the desktop.
Figure 6:
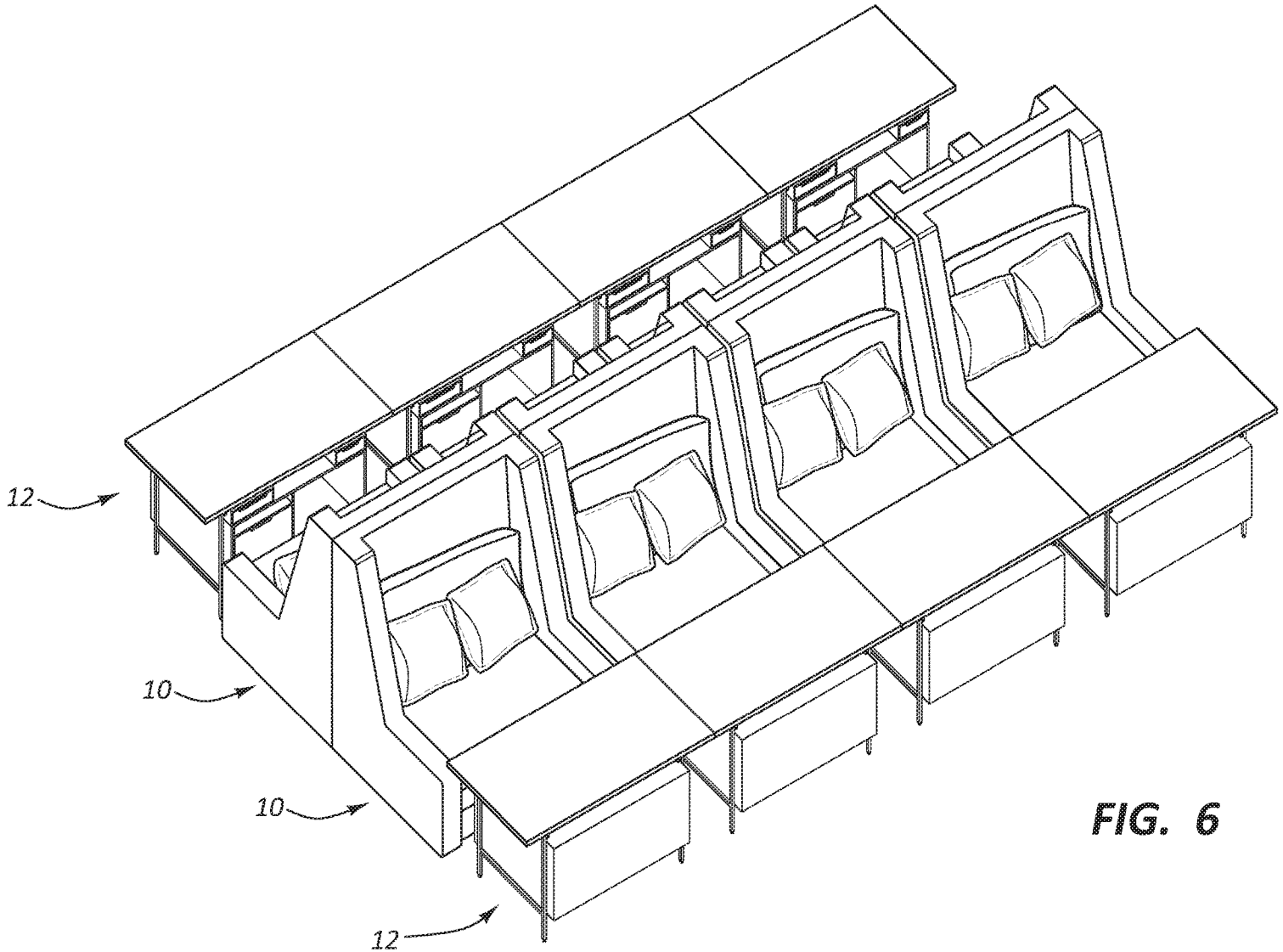
FIGS. 6-7 illustrate examples of multiple side by side embodiments of the workstation assemblies of FIGS. 1-4 in an office environment.
Figure 7:
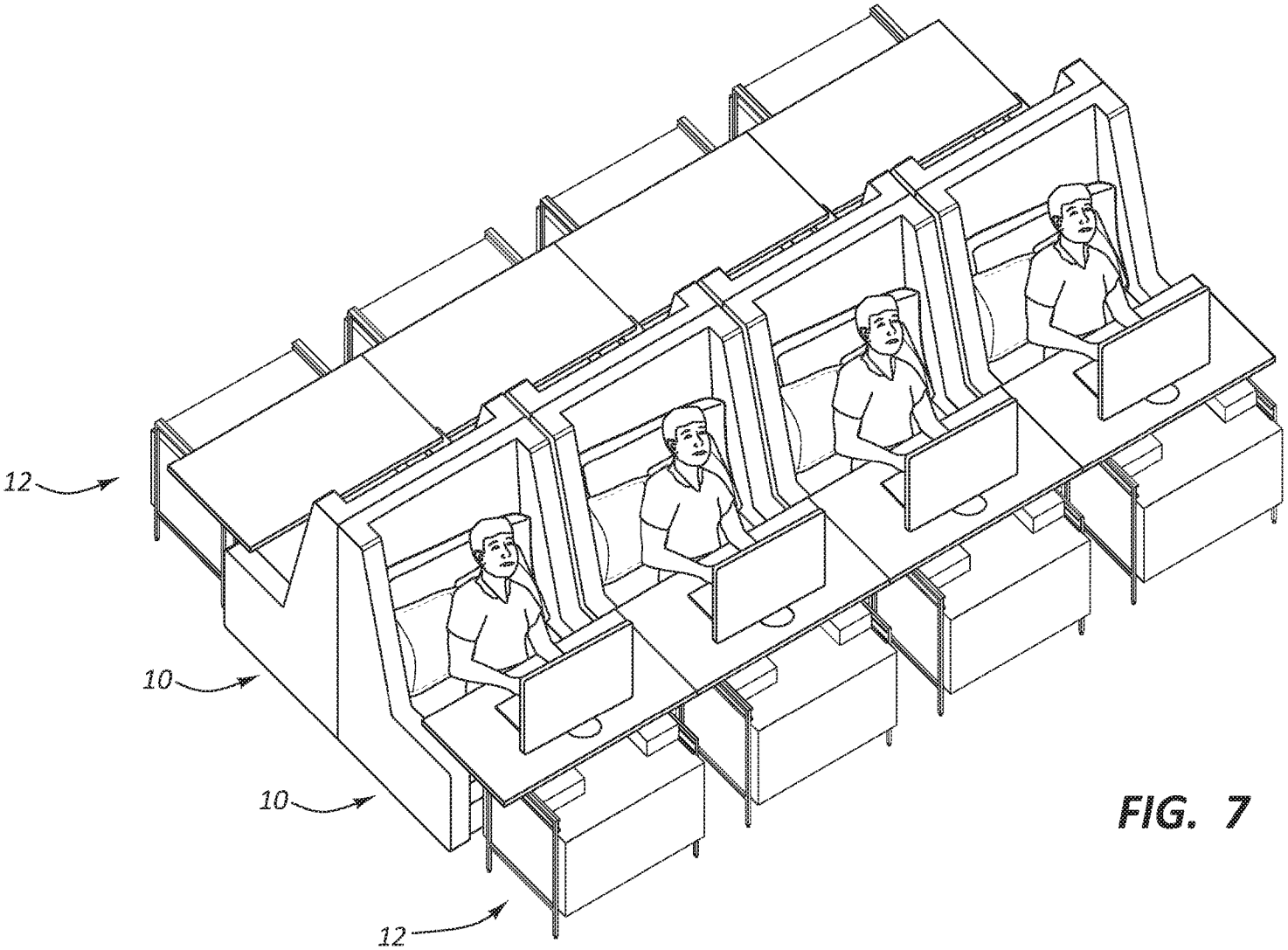
Figure 8:
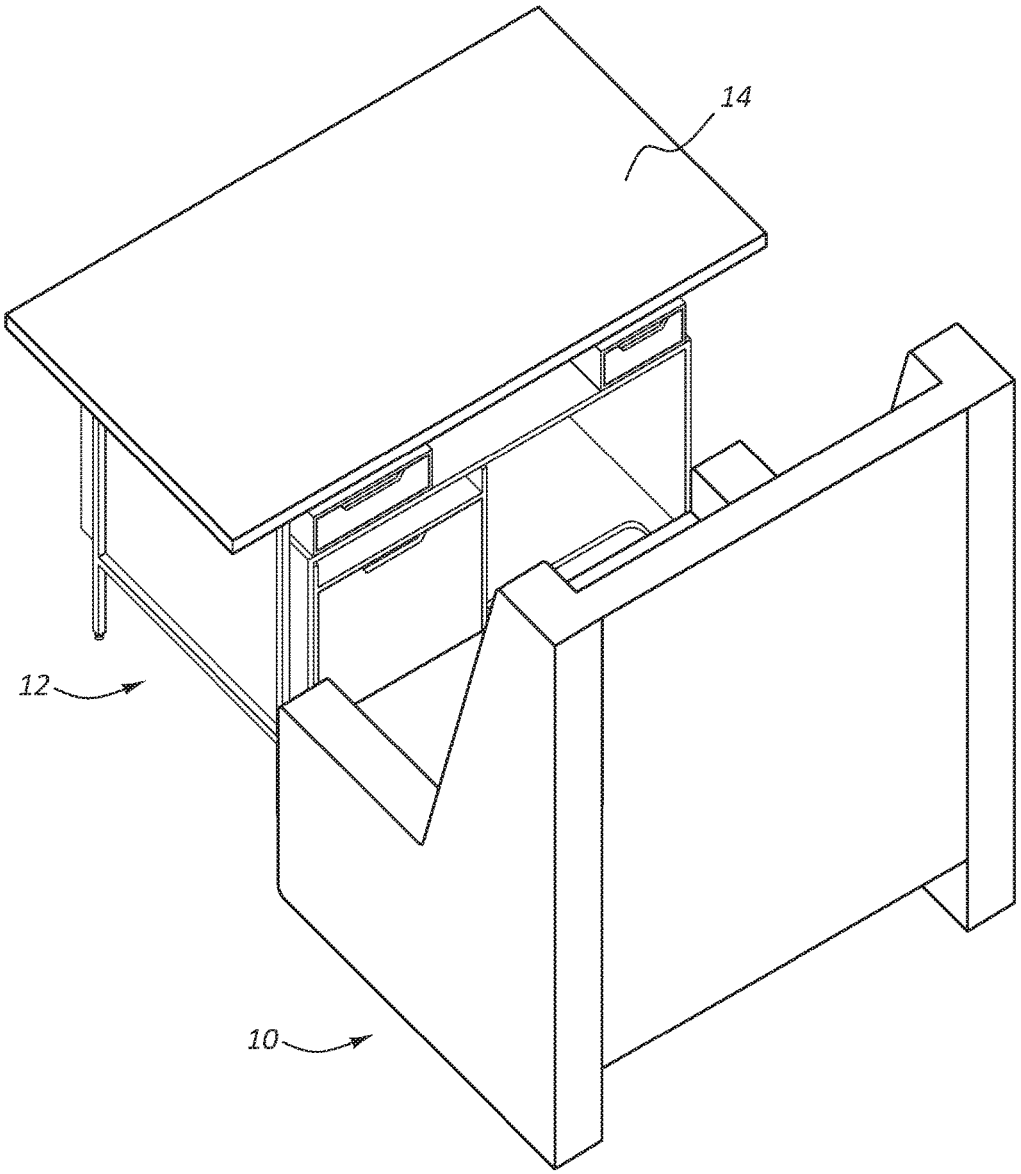
FIGS. 8-9 show rear and front views, respectively, of the workstation assembly of FIGS. 1-4.
Figure 9:
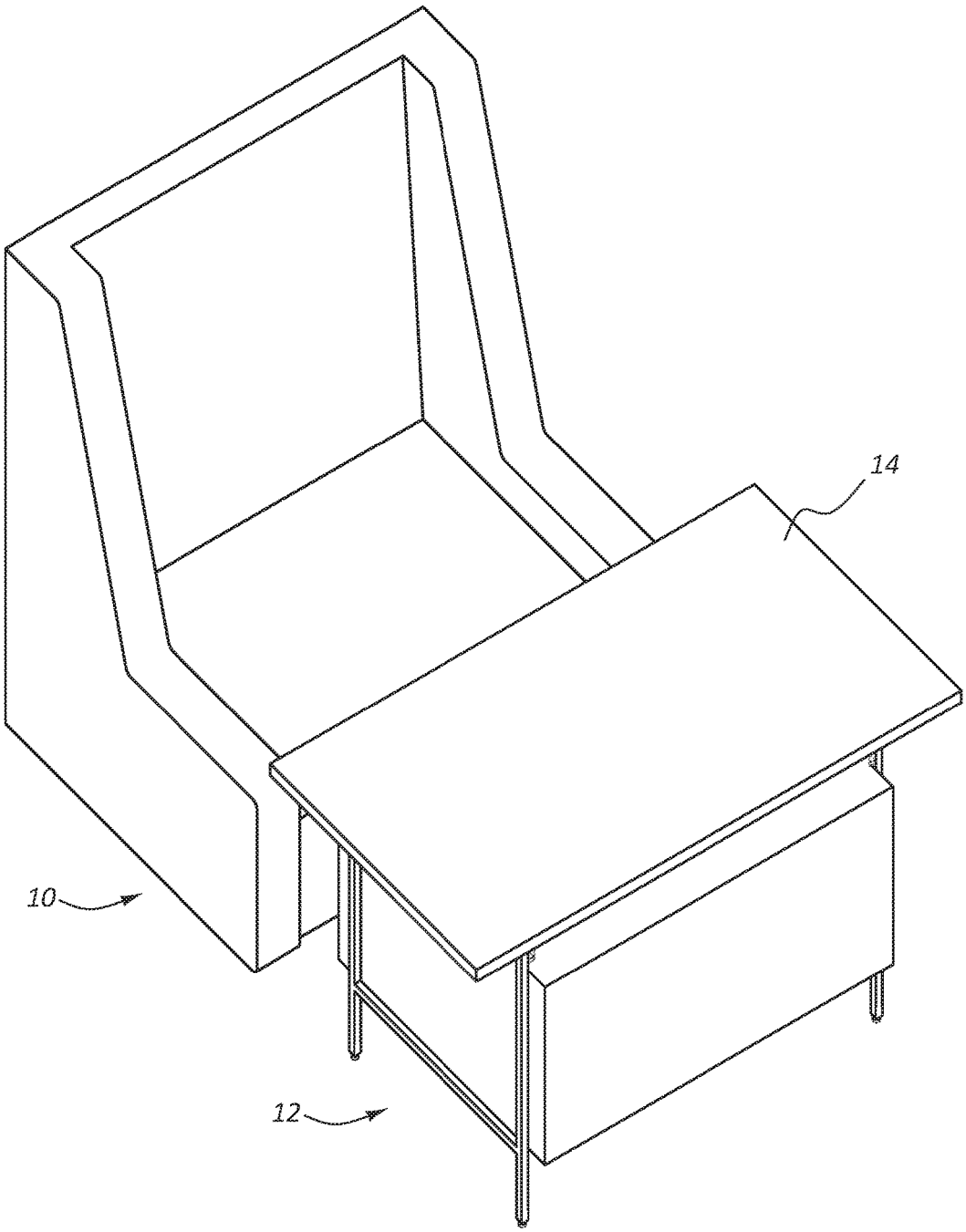

As shown in FIGS. 1-5, the present invention relates to a workstation assembly comprising (i) a chair 10; and (ii) a desk 12 with a moveable desktop 14 (e.g., an elongate, rigid panel) wherein desk 12 is positioned adjacent the chair 10, the chair 10 having a base 16, left and right arm rests 18, 22 linked to base 16 and a backrest 22 linked to base 16. The base 16 and cushion 30 collectively act as a seat that is configured to support the weight of a user. FIG. 5 shows an optional spring loaded detent 28 which interacts with desktop 14 to selectively position the desktop 14 of the desk 12 of the present invention into a desired position while it is being slid over the spring loaded detent 28. The opposite side of desk 12 may have one or more similar detents.

The chair 10 of the present invention may be positioned adjacent a variety of desks having a sliding desktop 14 that slides away from the frame 24 of the desk. Desk 12 includes a movable desktop 14 which can be selectively moved with respect to the frame 24 of the desk from a collapsed position shown in FIG. 1 to a partially extended position shown in FIG. 2. The desktop 14 moves away from the frame 24 of the desk 12 into a partially extended position or into the fully extended position of FIGS. 3-4 in which a distal end of desktop 14 is conveniently positioned adjacent the user's abdomen for convenient working by the user.

The desktop 14 is mounted on a sliding assembly 26 (see, e.g., FIGS. 11, 12*c*, 13, and 14), which is coupled to the desk frame 24. Through the use of the sliding assembly 26, the desktop 14 can be moved from the collapsed position of FIG. 1 to the extended positions of FIG. 2 or FIGS. 3-4.

In the extended position of FIG. 2, when the chair 10 is positioned adjacent the desk 12, as shown in FIG. 2, the desktop 14 rests on the armrests 18, 20 of the chair 10, as shown in FIG. 30. By resting on the armrests 18, 20 of the chair 10, the desk 12 and the desktop 14 on the desk 12 are more stable and the desktop 14 can be conveniently used by a user who can rest his/her arms on the desktop 14 as reflected in FIGS. 3 and 4. In use, as shown in FIGS. 1, the user can selectively slide the desktop outwardly from the collapsed position of FIG. 1 to the extended position of FIG. 3, then rest the user's hands and forearms on the desk for typing on a computer or operating a computer mouse, or for writing or drafting or other purposes. Optionally, as shown in FIG. 4, a user can rest the user's elbows and forearms on the desktop, thereby enabling the user to engage in a number of ergonomically useful and comfortable positions. The positioning of the desktop 14 on the armrests 18, 20 of the chair 10, thus creates an ergonomically comfortable and healthy posturing position which is both comfortable and healthy for user's musculature and skeletal system throughout a working day. This addresses the problem experienced by many users of discomfort while sitting at a desk and working throughout a work day. The positioning of the desktop in FIGS. 2-4 also supports the distal end of the desktop 14, providing support to the overall desk.

In one embodiment, the height of the desktop 14 is approximately 25 inches, although a variety of different heights are available depending upon the size of the user and other individual factors.

Details of the desk 12 are shown in FIGS. 10-16, although a variety of different desk embodiments having sliding desktops can be used to achieve the dynamic shown in FIGS. 1-4.

In one embodiment, a plurality of spring loaded detents 28 such as shown in FIG. 5, are employed in order to have a number of different pre-set positions in which the desktop can be temporarily positioned. For example, in one embodiment, first and second temporary set positions are available. For example, in one embodiment, first and second temporary set positions are available using a plurality of spring loaded detents such as shown in FIG. 5.

In one embodiment, a workstation assembly of the present invention is configured to ergonomically, comfortably seat and provide workspace for a user, comprising a chair 10 having a base 16 on which a user sits, and at least one armrest 18, 20 linked to the base 16; a backrest 22 linked to base 16; and a desk 12 comprising a desk frame 24, a sliding assembly 26 mounted on the desk frame 24, and a desktop 14 mounted on the sliding assembly 26, wherein the desk is configured such that the desktop can be in a compact position with respect to the desk frame, or can be moved from the compact position to an extended position with respect to the desk frame, wherein, in the extended position, a distal portion of the desktop 14 is positioned on the at least one arm rest.

Cushion 30 is positioned on base 16 to form a seat of the present invention. Backrest 22 is linked to the base 16, and first and second arm rests 18, 22 are linked to the base 16 and the back rest 22 such that a user's left and right arms can be conveniently rested on the first and second arm rests, 18, 20 respectively. The proximal portion of desktop 14 is mounted on the sliding assembly 26 such that a distal portion of the desktop 14 selectively extends away from the sliding assembly so as to be positioned on one or more armrests 18, 20.

Detent 28 is an example of a mechanism for providing a non-permanent fixed location for the desktop as it slides with respect to the desk frame. A plurality of detents may be used in order to provide a variety of different sliding positions.

The assembly of FIG. 1 is an example of a workstation assembly comprising (A) a chair, having a base on which a user sits, first and second arm rests linked to the base, and a back rest linked to the base and the armrests and extending upwardly with respect to the base such that a user can conveniently sit on the chair and rest the user's arms on one or both of the respective arm rests with the user's back against the back rest; and (B) a desk, comprising a desk frame, a sliding assembly mounted on the desk frame and a desktop having proximal portions and a distal portion, the proximal portion being mounted on the sliding assembly and the distal portion extending away from the sliding assembly, such that upon movement of the desktop, the distal portion of the desktop slides away from the desk frame and onto the armrests of the chair, thereby enabling the user sitting in the chair to comfortably place the user's arms onto the desktop for conveniently comfortable and ergonomic working in a work environment.

The workstation assembly further comprises a cushion 30 positioned on the base 16 of the chair 10. In the embodiment of FIG. 1, the "seat" of the present invention is comprised of the cushion 30 and the base 16 and, in one embodiment, has a height of approximately 18 inches on the top surface thereof. In another embodiment, the seat is comprised of a base without a cushion or is comprised of a base that is integral with a cushion. The "seat" is thus the object or series of objects on which the user sits.

FIG. 5 shows one or more mechanisms 28 for selectively locating the desktop in the desired position with respect to the desk frame. As shown in FIG. 1-2, the desktop can be selectively moved back and forth with respect to the desk frame 24 and the chair 10 supports the distal portion of the desktop 14 when the desktop 14 is in the extended position.

FIGS. 1-4 illustrate a method for providing a workstation, comprising (A) providing a chair having a base, first and second armrests linked to the base, and a backrest linked to the base; (B) providing a chair comprising a sliding assembly mounted on the frame of the chair and a desktop having a proximal portion mounted on a sliding assembly, the desktop having a distal portion, the distal portion being slidable away from the desk frame; and (C) placing the chair adjacent the desk such that the distal portion of the desktop of the desk can be selectively slid over the armrests of the chair while a user is sitting on the chair, such that the user can place the user's arms onto the distal portion of the desktop for convenient comfortable working using a workstation. The method of FIGS. 1-4 further comprises a user sitting on the chair, grasping the desktop and sliding the desktop towards the chair, such that the distal end of the desktop is positioned above and/or on the first and second armrests of the chair.

Arm rests 18, 20 may be linked to base 16 and to backrest 22 by being coupled thereto in the same or similar manner as described in connection with the furniture assembly disclosed in (i) U.S. Pat. No. 7,213,885, which is incorporated herein by reference and is entitled "Modular Furniture Assembly" to White, III et al; and/or (ii) U.S. Pat. No. 7,963,612 which is incorporated herein by reference and is entitled "Modular Furniture Assembly."

For example, arm rests 18, 20 and back rest 22 of the present invention may modular pieces that may be linked to base 16 of the present invention and/or to each other in the same or similar manner as described in connection with the transverse members, bases, and foot couplers disclosed in (i) U.S. Pat. No. 7,213,885, which is incorporated herein by reference and/or (ii) U.S. Pat. No. 7,963,612 which is incorporated herein by reference, such that the foot couplers disclosed in said patents maintain the arm rests 18, 20, back rest 22, and base 16 stably linked on or adjacent the ground, as opposed to casters, wheels, or other rolling objects that might move when desktop 14 is moved to the extended position by being pulled toward chair 10 by a user sitting in chair 10. Thus, in one such embodiment, the stable arm rests 18, 20, back rest 22, and base 16 positioned stably on or adjacent the floor are more convenient than an embodiment employing a caster, wheel or rolling object.

Base 16, arm rests 18, 20, and back rest 22 can thus be modular pieces that are selectively connected to each other and to other pieces to form chairs, couches, and a variety of configurations of furniture assemblies. Chair 10 is thus one embodiment of a furniture assembly of the present invention, other embodiments of furniture assemblies including couches, sofas, and a variety of other furniture configurations.

The seating range of approximately 15 inches high to approximately 21 inches high, e.g., 18 inches high, is a height range defined herein as "leisure seating." At this height, a typical person can sit in a chair 10 or couch with the user's feet out and back against the backrest in a relaxed setting, as opposed to a higher or lower height in which it is often difficult to relax while sitting. In this leisure seating environment, workers can be more productive long term and avoid some of the negative consequences of posturing that is uncomfortable and stress-inducing. By adding the rigid desktop 14 in connection with chair 10, a user is able to work in a leisure seating environment with a rigid worksurface adjacent the user's lap, enabling the user to be both simultaneously relaxed and productive.

For example, in one embodiment, the top surface of the desktop 14 is approximately 25 inches high and the top surface of the seat of the chair 10 is approximately 18 inches high. In one such embodiment, the rigid desktop 14 is about one inch thick, providing approximately 6 inches of legroom, keeping in mind however, that the cushion portion 30 of the seat of the chair 10 may tend to flex downward when receiving the weight of a user, thereby providing more than about 6 inches of legroom.

Positioning desktop 14 on one or more armrests 18, 20 is particularly valuable in the leisure seating height range because it provides significant stability to the desk 12 of the present invention, allowing the user to confidently relax and work, being both productive and comfortable, which is an ideal setting for a workplace environment. By being at sitting height, the desktop 14 on the armrests provides significant stability, receiving the weight of the user's elbows, and upper body as the user moves between different seating positions.

Figure 10A:
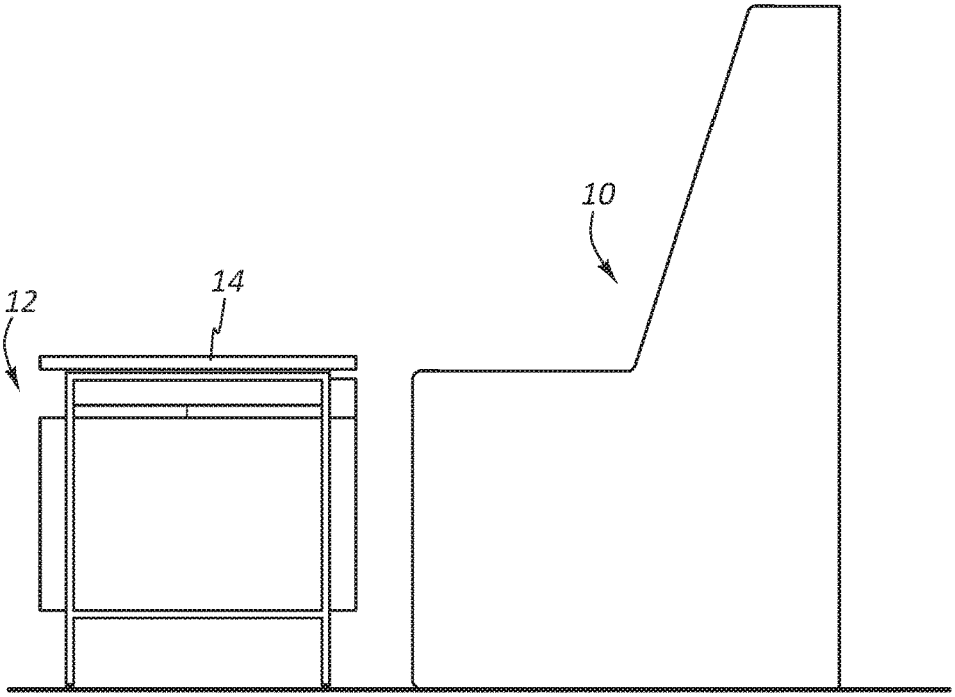
FIG. 10A shows the workstation assembly of FIGS. 8 and 9 in a side view. The opposing side view is the mirror image thereof.
Figure 10B:
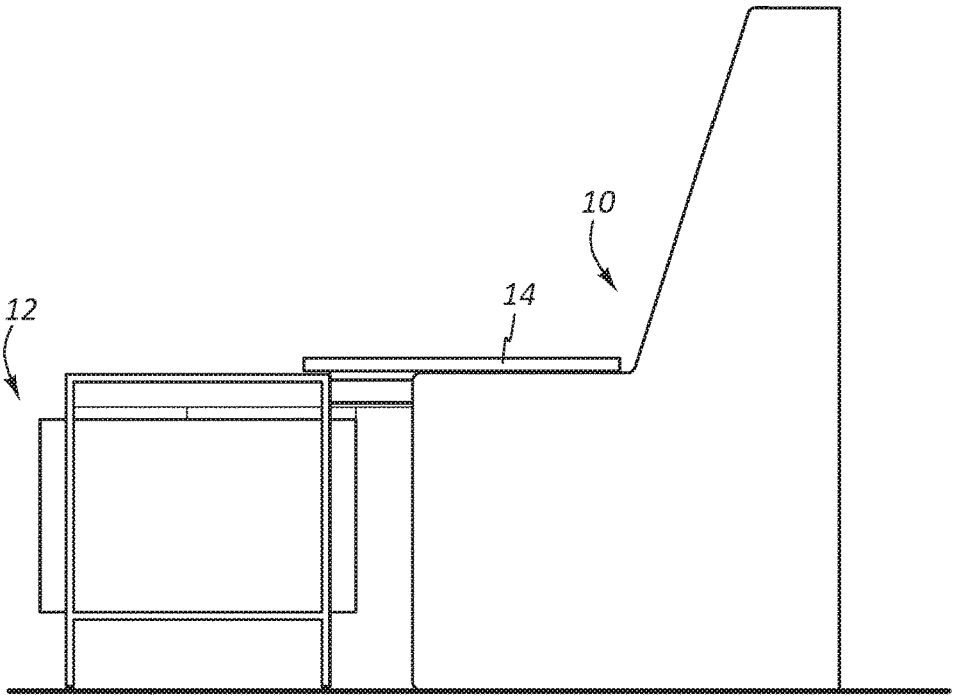
FIG. 10B shows the side view of FIG. 10A, wherein the desktop has been extended to an extended position such that the distal end thereof is positioned on the armrests of chair 10.
Figure 11:
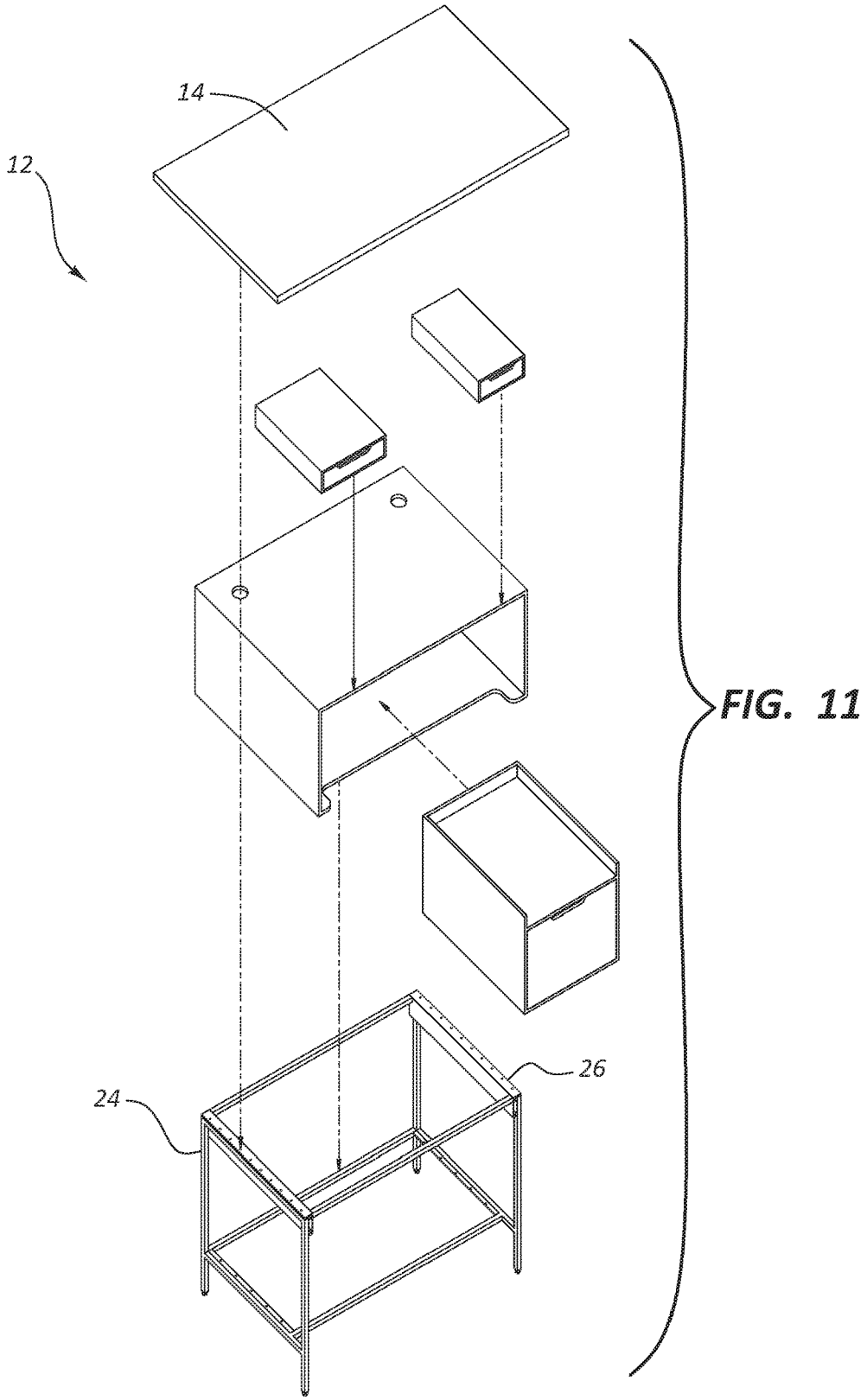
FIG. 11 shows an exploded view of the desk 12 of workstation assembly.
Figure 13:
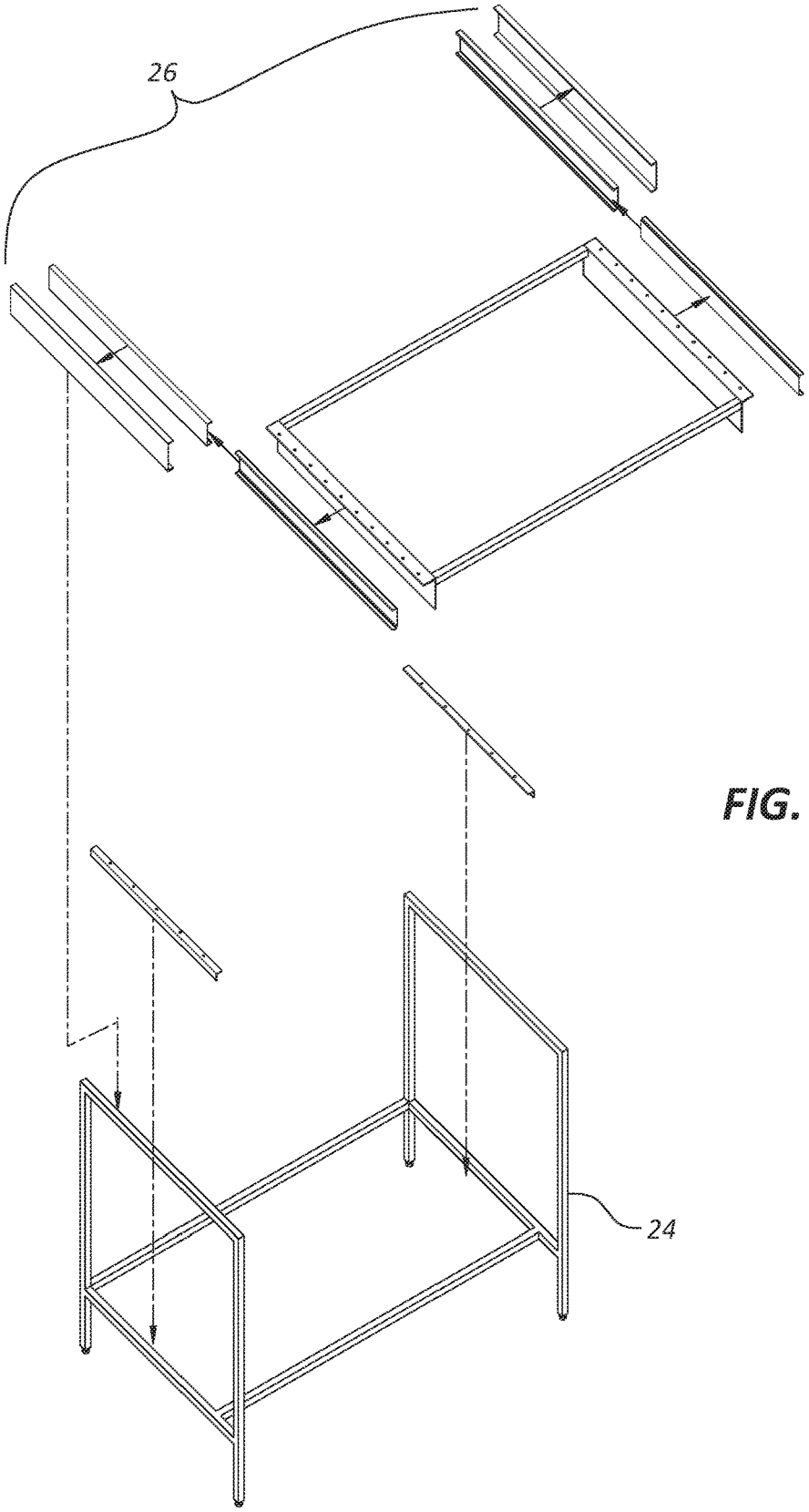
FIGS. 13 and 14 show exploded and assembled views, respectively, of the frame and sliding assembly of desk 12.
Figure 14:
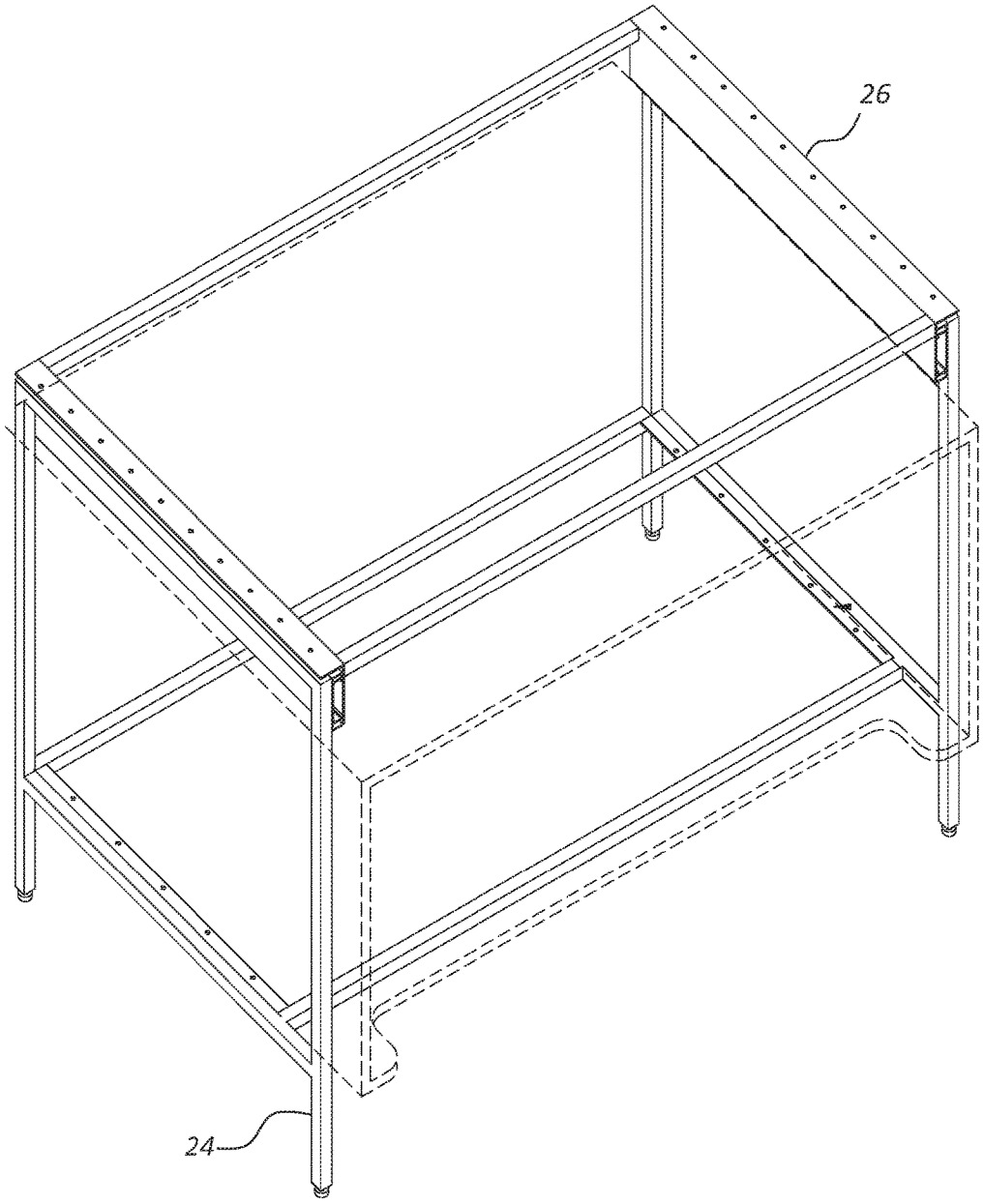
Figure 15:
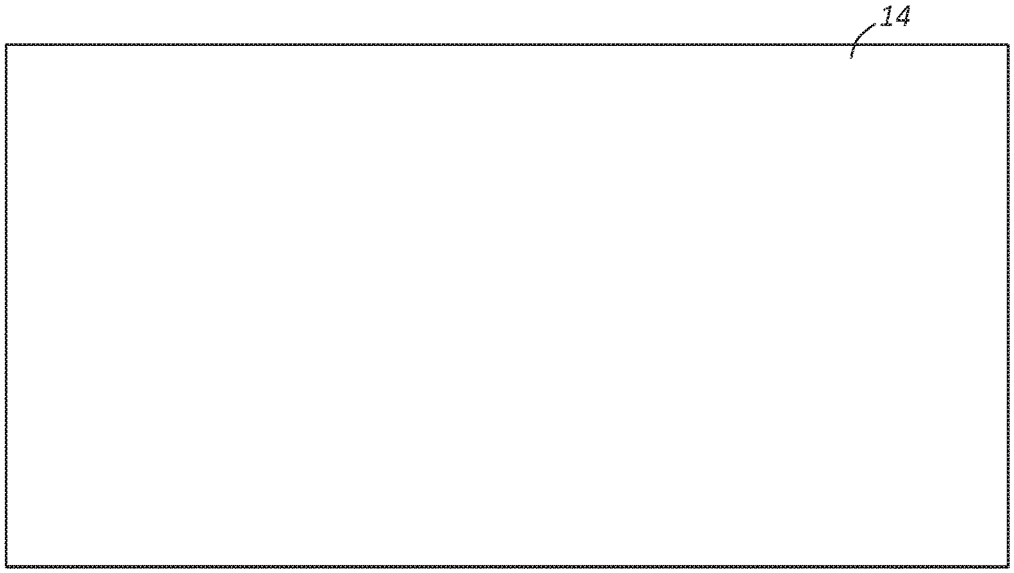
FIGS. 15 and 16 show top and bottom views, respectively of desk 12.
Figure 16:
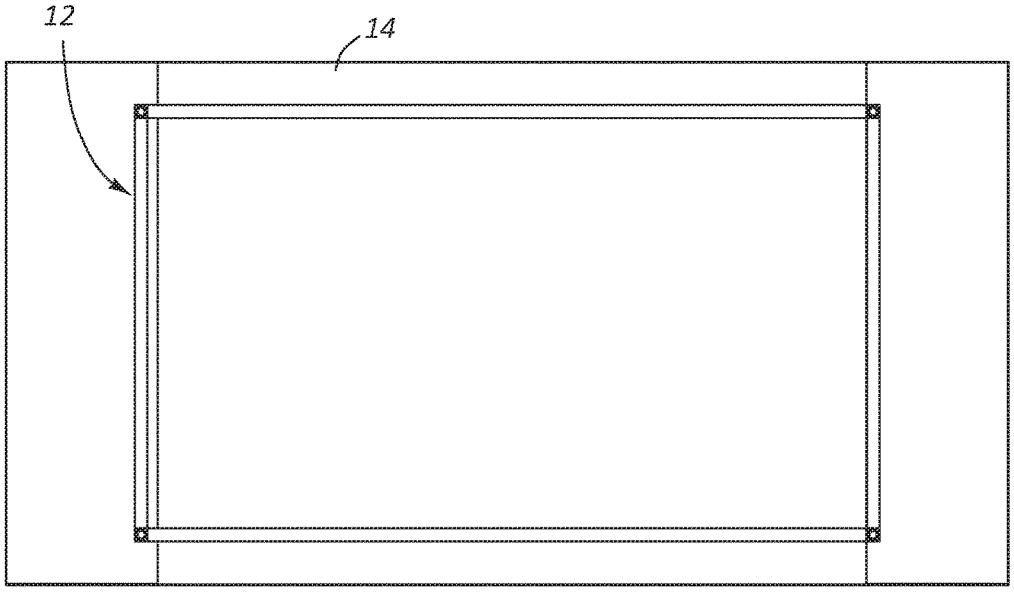

When chair 10 is at leisure seating height and the distal portion of desktop 14 is on the armrests 18, 20, as shown in FIG. 10B, for example, the user can also sit on the rigid desktop 14 when desired, which may occur in a relaxed work setting, which adds another benefit to the significantly stability of the symbiotic workstation of the present invention.

In addition to using the backrest 22, there are additional advantages of working at a leisure seating height using the workstation assembly of the present invention, which are important to ergonomics and general comfort. For example, at the more relaxed leisure seating height, the angle of the knees and hips is improved over sitting in a higher work-style chair. The possible sitting positions (forward, reclined, angled, sideways, etc.) at leisure seating height are also greater and different than when sitting in a cramped, higher work-style chair. This distinction gives the present invention important utility and offers a unique benefit over traditional work stations.

As a result of the symbiotic relationship between the applicant's chair 10 and desk 12, and the stability of the extended position of FIG. 10B, a user can be both "kicking back" and getting work done. The present invention thus offers a comfortable, convenient leisure seating height solution.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A symbiotic workstation assembly configured to ergonomically, comfortably seat and provide workspace for a user, comprising:

a furniture assembly having a seat on which a user sits, the seat comprising (i) a base, (ii) first and second armrests, and (iii) a backrest; and a desk comprising a desk frame, a sliding assembly mounted on the desk frame, and a desktop mounted on the sliding assembly, wherein the desk is configured such that the desktop can be in a compact position with respect to the desk frame, or can be moved from the compact position to an extended position with respect to the desk frame, wherein, in the extended position, a distal portion of the desktop rests on the first and second armrests;

wherein the first and second armrests, backrest, and base are stably linked on or adjacent a support surface as the desktop is moved to the extended position;

wherein a top surface of the desktop is in the range of approximately 22 inches high to approximately 28 inches high and wherein a top surface of the seat is in the range of approximately 15 inches high to approximately 21 inches high;

wherein each of the first and second armrests have an upper surface, a lower surface of the distal portion of the desktop being selectively positioned on the upper surfaces of the first and second armrests such that the first and second armrests support the distal portion of the desktop; and wherein the backrest and first and second armrests are modular pieces that are selectively connected to the base.

2. A workstation assembly as recited in claim 1 wherein the desktop has a flat lower surface that is selectively positioned flush with substantially flat upper surfaces of the first and second armrests.

3. A workstation assembly as recited in claim 1, wherein the seat comprises a cushion positioned on the base.

4. A workstation assembly as recited in claim 1, wherein the furniture assembly rests stably on the support surface without rolling as the desktop is moved to the extended position by being pulled toward the furniture assembly by a user sitting in the furniture assembly.

5. A workstation assembly as recited in claim 1, wherein the top surface of the desktop is in the range of approximately 23 inches high to approximately 27 inches high and wherein the top surface of the seat is in the range of approximately 16 inches high to approximately 20 inches high.

6. A workstation assembly as recited in claim 1, wherein the top surface of the desktop is in the range of approximately 24 inches high to approximately 26 inches high and wherein the top surface of the seat is in the range of approximately 17 inches high to approximately 19 inches high.

7. A workstation assembly as recited in claim 1, wherein the top surface of the desktop is approximately 25 inches high and wherein the top surface of the seat is approximately 18 inches high.

8. A workstation assembly as recited in claim 1, wherein the desktop has a substantially flat lower surface.

9. A leisure seating workstation assembly comprising:

a chair, having a seat on which a user sits, an armrest and a backrest linked to the seat, the seat having a base;

a desk, comprising a desk frame, a sliding assembly mounted on the desk frame and a desktop having a proximal portion and a distal portion, the proximal portion being mounted on the sliding assembly and the distal portion extending away from the sliding assembly, wherein the desktop can be selectively moved back and forth with respect to the desk frame such that upon movement of the desktop, the distal portion of the desktop slides away from the desk frame and onto the armrest;

wherein the armrest, backrest, and base are stably linked on or adjacent a support surface as the desktop is moved to the extended position;

wherein a distal portion of the desktop extends away from the desk frame such that the distal portion of the desktop rests on the armrest; and wherein the desktop has an upper surface and a lower surface and the armrest has an upper surface, the lower surface of the desktop being fixedly positioned at a height flush with the upper surface of the armrest, such that the distal portion of the desktop is configured to be stable on the armrest and one or more forces pushing down on the upper surface of the desktop are transferred to the arm rest rather than to the sliding assembly or desk frame.

10. A workstation assembly as recited in claim 9, wherein the chair rests stably on the support surface without rolling as the desktop is moved to the extended position by being pulled toward the chair by a user sitting in the chair.

11. A workstation assembly as recited in claim 9 wherein the backrest and armrest are modular pieces that are selectively connected to the base.

12. A workstation assembly as recited in claim 9, wherein the chair is a non-rolling chair.

13. A workstation assembly as recited in claim 9 further comprising one or more mechanisms for non-permanently locating the desktop in a set desired position with respect to the desk frame.

14. A method for providing a workstation, comprising:

providing a chair having a base, and an armrest and a backrest linked to the base;

providing a desk comprising a sliding assembly mounted on the frame of the desk and a desktop having a proximal portion mounted on a sliding assembly, the desktop having a distal portion, the distal portion being slidable away from the desk frame onto the armrest of the chair;

placing the chair adjacent the desk such that the distal portion of the desktop can be selectively slid over the armrest of the chair;

wherein the armrest, backrest, and base are stably linked on or adjacent a support surface as the desktop is moved to the extended position by being pulled toward the chair;

wherein the desktop has a substantially flat lower surface and the armrest has a substantially flat upper surface, the substantially flat lower surface of the desktop being selectively positioned flush with the substantially flat upper surface of the armrest; and wherein a top surface of the desktop is in the range of approximately 22 inches high to approximately 28 inches high and wherein a top surface of the seat of the chair is in the range of approximately 15 inches high to approximately 21 inches high.

15. A workstation assembly as recited in claim 14, the backrest and armrest being modular pieces that are selectively connected to the base.

16. A workstation assembly as recited in claim 14, wherein the top surface of the desktop is in the range of approximately 24 inches high to approximately 26 inches high and wherein the top surface of the seat of the chair is in the range of approximately 17 inches high to approximately 19 inches high.

17. A method as recited in claim 14, further comprising a user sitting on the chair, grasping the desktop and sliding the desktop towards the chair, such that the desktop is positioned above and/or on the armrest of the chair.

18. A method as recited in claim 14, further comprising a user sitting on the chair, grasping the desktop and sliding the desktop towards the chair, such that the desktop is positioned on the armrest of the chair.

* * * * *